US005762487A

United States Patent [19]

Kujawski

[11] Patent Number: 5,762,487

[45] Date of Patent: Jun. 9, 1998

[54] DECORATIVE CANDLES

[75] Inventor: Elaine M. Kujawski, Eastpointe, Mich.

[73] Assignee: Coventry Creations, Inc., Clinton Township, Mich.

[21] Appl. No.: 721,744

[22] Filed: Sep. 27, 1996

[51] Int. Cl.[6] ..... F23D 3/16

[52] U.S. Cl. ..... 431/289; 431/125; 431/288; 431/126

[58] Field of Search ..... 431/325, 288, 431/289, 125, 126

[56] References Cited

U.S. PATENT DOCUMENTS

| | | | |
|---|---|---|---|
| 3,702,495 | 11/1972 | Renoe | 29/428 |
| 3,730,674 | 5/1973 | Gross | 431/325 X |
| 3,797,990 | 3/1974 | Rogers et al. | 431/291 |
| 3,898,039 | 8/1975 | Lin | 21/108 |
| 4,077,110 | 3/1978 | Reiher | 29/458 |
| 4,419,070 | 12/1983 | Gustafson | 431/126 |
| 4,539,258 | 9/1985 | Panush | 428/324 |
| 4,568,270 | 2/1986 | Marcus et al. | 431/288 |
| 4,615,940 | 10/1986 | Panush et al. | 428/324 |
| 5,193,994 | 3/1993 | Schirneker | 431/293 |

*Primary Examiner*—Larry Jones
*Attorney, Agent, or Firm*—Dykema Gossett PLLC

[57] ABSTRACT

Decorative candles form a pool of molten wax near the candle flame in which optically active particles swirl under the movement of convection currents in the molten wax.

15 Claims, 1 Drawing Sheet

DECORATIVE CANDLES

TECHNICAL FIELD OF THE INVENTION

The present invention relates generally to candles and candle-making techniques and, more specifically, provides unique candles which provide cascading luminous effects.

BACKGROUND OF THE INVENTION

Candles have served as a source of light for thousands of years. Numerous materials have been used to make candles and, in fact, until cotton was introduced in the middle ages, the pith of rushes was actually used to make candle wicks. Tallow has been used for the candle body but generates an abundance of smoke, even to the point that it obscures the light produced by the flame. Beeswax has also been used (which produces less smoke and more light than tallow), but has historically been a scarce commodity. Techniques which were developed using beeswax have, however, paved the way for more modern candle-making processes using paraffin wax. Most modern candles are based on paraffin wax which is a petroleum-based product.

Particularly after the advent of gas and then electric lighting, the candle-making industry has focused on the aesthetic aspects of candles rather than merely on their functional attributes (i.e., serving as a source of light). A number of candle-making techniques are known which can be adapted to Droduce various visual effects. For example, in candle-dipping processes, the wicks are dipped into the molten wax and removed such that the wax cools to form a layer or cylinder encasing the wick. This process is repeated to produce a buildup of wax which forms the candle body. To produce tapers, the wick is drawn through an elongated dish of molten wax, after which the tapers are cut to length. A variation of dipping is candle pouring where small quantities of wax are melted and then poured over the wick sequentially to produce the wax buildup. Pouring is still often used for candle sculpturing.

Another candle-making technique, casting, uses molds to form the candle body. A mold defining a cavity having the desired candle geometry is provided and a wick is suspended from a crossbar over the mouth of the mold. Molten wax is prepared and poured into the mold cavity and allowed to solidify. Once the wax has set, the candle is removed from the mold. Although not typically necessary with the use of paraffin wax and stearine, release agents can be applied to the inside surfaces of the mold or introduced into the wax to facilitate removal of the candle. Numerous materials can be used to form the mold, such as glass, metal, plastic, plaster, or even cardboard.

As will be appreciated by those skilled in the art, a lighted candle produces heat, which in turn creates a small pool of molten wax circumscribing the wick. By means of capillary action, the molten wax moves up the wick, where it serves as fuel for the combustion reaction. That is, the wax is vaporized, whereupon it burns. As will also be appreciated by those skilled in art, the size of the wick relative to the top surface of the candle is somewhat important since it must be large enough to generate heat to form a pool of molten wax but not so large as to rapidly melt the candle. In addition, in the ideal candle, the wax and wick are consumed at complementary rates.

Many candle wicks comprise braided cotton and may also contain certain chemicals which cause the wick to bend and disintegrate as an ash so that the wick length is relatively constant vis-á-vis the wax body. Modern candles use blends of wax with various melting points which affect the length of time that the candle will burn. Low melting point wax blends are soft and are most useful in dipping or pouring processes. For many purposes, general medium-temperature paraffin wax can be used. As will also be appreciated, the different blends of waxes vary in appearance; they typically can range from opaque to translucent white. Opaque waxes are more easily dyed. Translucent waxes tend to serve as illuminators of the light produced by the wick. Of course, in addition to its aesthetic qualities, the candle should produce a steady flame, minimal smoke, and should burn for as long as possible.

Casting has been used to produce decorative candles of various shapes, as well as striped candles, mosaic, marbled, painted and carved candles, to enhance the aesthetic qualities of the candle. More specifically, with respect to decorative effects, in casting, the mold can be filled with discrete layers of wax of different colors. The mold can be tilted to produce stripes that are at an angle. In addition, dipped stripes can be produced by taking a cast candle and then dipping various portions in waxes of distinct colors. By grading the striping colors from light to dark, many combinations can be obtained.

A random mosaic effect can be obtained by adding solid wax chips of various colors to the mold and then filling with a molten wax. A marbled effect is typically produced by adding oil to the molten wax. The oil will then follow convection currents in the wax. It is known to tint the oil with a soluble dye to enhance this effect. Air bubbles can be created by aerating the wax before or after it is poured into the mold. It is also known to paint wax candles to create a decorative effect. Other surface decorations are known in the form of paper cutouts and the like which are glued to the candle.

It is also known to add pieces of ice to the wax to create a honeycomb effect. It is further known to place crumpled pieces of aluminum foil in the mold after adding the wax to create visible objects in translucent wax candles.

Although many of these decorative effects produce pleasing candles, for the most part, they are all static, i.e., they do not impart any sense of motion to the candle.

Accordingly, it would be desirable to produce a decorative effect which produces a random, moving visual effect in candles. The present invention achieves this goal.

SUMMARY OF THE INVENTION

The present invention in one aspect provides a decorative candle which when ignited produces a visually pleasing appearance which imparts a sense of rhythmic swirling movement. The candle includes a wick and a wax body surrounding the wick. The wax body may be translucent or opaque and contains a plurality of macroscopic inorganic particles. These macroscopic particles are of such size and density that upon the formation of a molten pool of wax immediately adjacent the wick flame, the particles swirl in the molten pool in convection currents, thereby reflecting light and creating an undulating, cascading particle flow which imparts a sense of motion that is visually pleasing.

In one aspect, the inorganic particles are particles of mica ($K_2A_{16}Si_6O_2\mathbf{0}(OH)_4$ or other silicon-based oxides. In another aspect, the mica particles are provided in the wax along with a coating of titanium oxide to produce an optically active particle.

In still another aspect of the present invention, a decorative candle is provided having a wick and a wax body. The wax body has an inner core and an outer coating. The outer coating contains a plurality of inorganic macroscopic particles. These macroscopic particles are of such size and density that upon the formation of a molten pool of wax immediately adjacent the wick flame, the particles swirl in the molten pool in convection currents creating a pleasing visual effect. Again, the inorganic particles are preferably particles of mica ($K_2A_{16}Si_6O_20(OH)_4$). In another aspect, the mica particles are provided in the wax along with a titanium dioxide coating.

DETAILED DESCRIPTION OF THE PREFERRED EMBODIMENTS OF THE INVENTION

Figure 1:
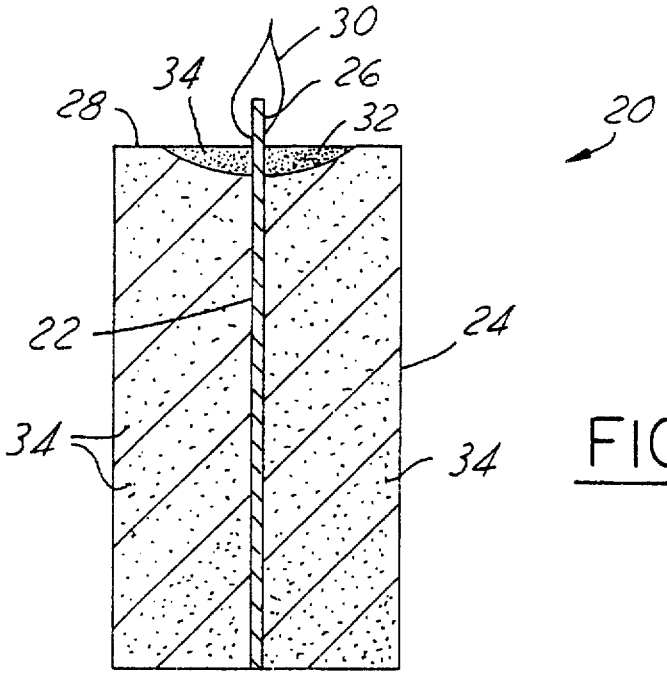
FIG. 1 is a cross-sectional front elevational view of a candle made in accordance with the present invention (not to scale).

Referring now to FIG. 1 of the drawings, decorative candle 20 is shown having wick 22 extending through and encased in wax body 24. A portion 26 of wick 22 extends above adjacent wax surface 28 which, when candle 20 is lighted to produce flame 30, generates molten wax pool 32. Circulating in wax pool 32, macroscopic inorganic particles 34 are shown, the nature of which will be more fully described hereinafter.

Wick 20 may comprise a number of materials, but will preferably include cotton. As will be appreciated by those skilled in the art, wick 20 should have several desirable characteristics. Preferably wick 20 should be readily ignitable with an ordinary match or lighter. Wick 20 should slowly turn to ash to prevent an excessive length from extending above surface 28 as the wax body is consumed through the action of vaporization and combustion by flame 30. The relative dimensions of wick 20 vis-a-vis wax body 24 should provide a molten pool 32 that remains predominantly within the top circumference defined by wax surface 28, but may allow some spill over of wax from pool 32 onto the sides of candle 20. In addition, wick 22 should be of sufficient size and should generate sufficient heat to maintain a pool 32 that is adequate to provide enough vapor to fully sustain flame 30.

With these characteristics in mind, the most preferred wicks for use as wick 32 in the present invention are zinc core wicks which are well known in the industry. Zinc core wicks are known to conduct heat in the wax just below surface 28 such that this thermal conduction assist in the formation of wax pool 32. As will be understood, it is most desirable to create a large but confined wax pool 32 in order to maximize the visual area of the circulating particles. Zinc core wicks which are suitable for use in the present invention may be obtained from the Candela company, Royal Oak, Mich., under the trade name Zinc Core Wick 44-24-18.

In addition to zinc core wicks, preferred wicks for use in the present invention are paper core cotton wicks, braided cotton wicks, and pre-waxed wicks, so long as the various parameters are adjusted such that a stable pool 32 is maintained. The nature and sources of these additional wicks will be known to those skilled in the art of candle-making.

Again, the size of wick 22 may vary, but in most instances wick 22 will have a cross-sectional diameter of from about 1/32 in. to about 1/8 in. Of course, the length of wick 22 will solely be a function of the length of candle 20.

A number of different materials can be used to form wax body 24. Most preferred are petroleum-based waxes (i.e., paraffin waxes) although bees wax can be used to form body 24. Preferably, the wax used to form body 24 will have a melting point of from about 140° C. to about 220° C. and more preferably from about 160° C. to about 180° C. Suitable waxes may be obtained from the Amoco company under the designations R-30, R-35, R-40, R-50.

Macroscopic inorganic particles 34 provide the visual effects which are the key to the present invention. It is important that particle 34 be large enough to be seen by the unaided eye, but small enough such that they are buoyant in wax pool 32 and can be moved or circulated by convection currents around pool 32. Most preferably, particles 34 are of generally equal size, that is within 10–20 percent of a mean diameter. Preferably, particles 34 are between about 1 to about 300 microns in diameter and more preferably from about 20 to 80 microns. Most preferably, the average or mean particle size is from about 80 to about 140 microns in diameter. In terms of quantity, it is preferred that about 1/8 lb. to about 2 lbs., more preferably about 1/2 lb. to about 1 lb. of particles 34 be provided per about 5 to about 20 and more preferably about 10 to 15 gallons of wax.

The preferred particles 34 as stated are comprised of ordinary mica ($K_2A_{16}Si_6O_20(OH)_4$ or other silicon-based oxides. Other metal oxides such as iron or tin oxides, for example, may be suitable. Most preferably particles 34 are optically active, that is, they are coated with a material which selectively reflects certain wavelengths of light to produce a color effect. Coated mica particles of this type are typically coated with titanium dioxide. The layer thickness of the oxide determines the color of the particles. Particles suitable for use as particles 34 which are optically active in this manner may be obtained from EM Industries of Hawthorne New York under the trade names "AFFLAIR 163 Shimmer Pearl, "AFFLAIR Shimmer Gold"" and other "AFFLAIR" particles.

The preferred particles for particles 34 will have a specific gravity of from about 2.0 to 3.5 and most preferably about 3.0 which helps provide continuous suspension of particles 34 in wax pool 32 as well as allows particles 34 to circulate in convection currents in the molten wax.

In terms of preparation of candles 20, the selected wax is heated to its melting point and is then combined with the mica particles by slow mixing such that air bubbles are not formed. A mold having the wick suspended therein is then prepared, including if desired, through the application of a release agent on the inner surfaces of the mold. The molten wax/particle mixture is then poured into the mold and allowed to solidify. The fully cast candle is then removed in the customary manner. Of course based on the teachings of the present invention other candle-forming techniques such as pouring or dipping could be used to form the candle body and these techniques are specifically included herein.

Figure 2:
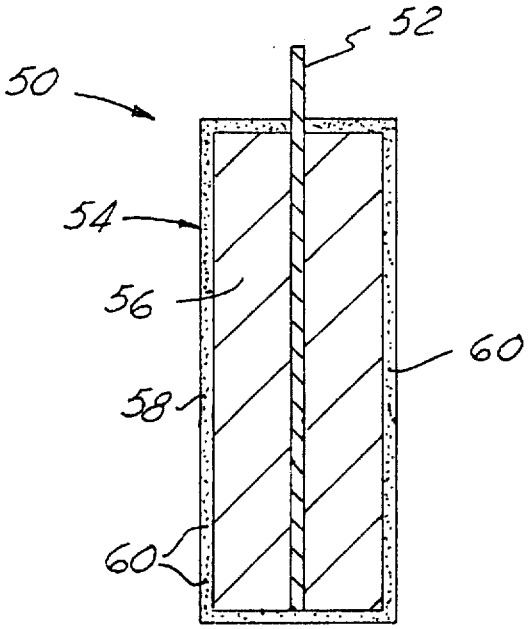
FIG. 2 is a cross-sectional front elevational view of a decorative candle made in accordance with the present invention in another embodiment (not to scale).

In still another embodiment of the present invention, and referring now to FIG. 2 of the drawings, candle 50 is shown having wick 52 and wax body 54. Wax body 54 is made of two parts, inner core 56 and outer coating 58. In this embodiment of the invention, candle 50 is made in the customary manner by casting inner core 56 around wick 52. Following solidification of inner core 56, the intermediary candle is dipped into a molten wax bath containing the preferred inorganic particles 60 therein in the size range and amounts described in connection with the first embodiment described above. In this manner, outer coating 58 is formed which contains particles 60 therein. Any number of techniques may be used to form outer coating 58 (as well as inner core 56) such as pouring or the like.

Thus, it is apparent that there has been provided in accordance with the invention a method and apparatus that fully satisfies the objects, aims and advantages set forth above. While the invention has been described in connection with specific embodiments thereof it is evident that many alternatives, modifications, and variations will be apparent to those skilled in the art in light of the foregoing description. Accordingly, it is intended to embrace all such alternatives, modifications and variations that fall within the spirit and broad scope of the appended claims.

What is claimed is:

1. A decorative candle, comprising:

a wick for producing a flame;

a wax body surrounding said wick for producing a pool of molten wax adjacent said flame, said wax body including a plurality of macroscopic inorganic particles of sufficient quantity and size such that said inorganic particles create a visible swirling effect in said pool of molten wax, and wherein said inorganic particles are optically active and have a titanium coating.

2. The decorative candle recited in claim 1, wherein said titanium coating reflects light to produce a color.

3. The decorative candle recited in claim 1, wherein said inorganic particles are metal oxides.

4. The decorative candle recited in claim 1, wherein said inorganic particles are mica.

5. The decorative candle recited in claim 1, wherein said inorganic particle range in diameter from about 10 to about 300 microns.

6. The decorative candle recited in claim 1, wherein said inorganic particles have a specific gravity of from about 2.0to about 3.5.

7. The decorative candle recited in claim 6, wherein said paraffin wax has a melting point of between about 140° C. and 220° C.

8. The decorative candle recited in claim 1, wherein said wick is a zinc core wick.

9. The decorative candle recited in claim 1, wherein said wick is a paper core cotton wick.

10. The decorative candle recited in claim 1, wherein said wick is a zinc core.

11. The decorative candle recited in claim 1, wherein said wax is selected from the group consisting of petroleum-based waxes and bees wax.

12. A decorative candle, comprising:

a wick for producing a flame;

a wax body in which a portion of said wick is encased, said wax body having a melting point such that a portion of said wax body adjacent said flame becomes molten in response to heat generated by said flame, said wax body having an inner core and an outer coating, said outer coating having a region adjacent said flame, said outer coating of said wax body containing a plurality of macroscopic inorganic particles of sufficient quantity and size such that said inorganic particles create a visible swirling effect in said molten wax, and wherein said inorganic particles are optically active and have a titanium coating.

13. The decorative candle recited in claim 12, wherein said titanium coating reflects light to produce a color.

14. The decorative candle recited in claim 12 wherein said inorganic particles are metal oxides.

15. A decorative candle, comprising:

a wick for producing a flame, a wax body in which a portion of said wick is encased, said wax body having a melting point such that a portion of said wax body adjacent said flame becomes molten in response to heat generated by said flame, and wherein said inorganic particles are mica.

* * * * *